US006599000B2

(12) United States Patent
Nolan et al.

(10) Patent No.: US 6,599,000 B2
(45) Date of Patent: Jul. 29, 2003

(54) INTERIOR LAMP FOR PRODUCING WHITE LIGHT USING BRIGHT WHITE LEDS

(76) Inventors: Steven T. Nolan, 4260 Arthur La., Beaumont, TX (US) 77706; Donald R. Hebert, 1007 Gene Dr., Lumberton, TX (US) 77657

( * ) Notice: Subject to any disclaimer, the term of this patent is extended or adjusted under 35 U.S.C. 154(b) by 0 days.

(21) Appl. No.: 09/976,906

(22) Filed: Oct. 15, 2001

(65) Prior Publication Data

US 2003/0072157 A1 Apr. 17, 2003

(51) Int. Cl.[7] ..... F21S 6/00

(52) U.S. Cl. ..... 362/414; 362/413; 362/411; 362/231

(58) Field of Search ..... 362/411, 413, 362/414, 231

(56) References Cited

U.S. PATENT DOCUMENTS

| | | | | | |
|---|---|---|---|---|---|
| 3,543,019 | A | * | 11/1970 | Jacobsen | 362/413 |
| 3,652,848 | A | * | 3/1972 | Miller et al. | 362/410 |
| 4,677,533 | A | * | 6/1987 | McDermott et al. | 362/240 |
| 4,985,661 | A | * | 1/1991 | Lin | 315/154 |
| 5,065,292 | A | * | 11/1991 | Aubrey | 362/410 |
| 5,339,233 | A | * | 8/1994 | Yang | 362/414 |
| 5,655,830 | A | | 8/1997 | Ruskouski | |
| 5,813,753 | A | * | 9/1998 | Vriens et al. | 362/293 |
| 5,848,837 | A | | 12/1998 | Gustafson | |
| 6,016,038 | A | | 1/2000 | Mueller | |
| 6,149,283 | A | * | 11/2000 | Conway et al. | 362/236 |
| 6,161,910 | A | * | 12/2000 | Reisenauer et al. | 362/235 |
| 6,163,038 | A | | 12/2000 | Chen | |
| 6,218,785 | B1 | | 4/2001 | Incerti | |
| 6,227,679 | B1 | | 5/2001 | Zhang | |
| 6,234,645 | B1 | * | 5/2001 | Borner et al. | 362/231 |
| 6,250,774 | B1 | | 6/2001 | Begemann | |
| 6,268,801 | B1 | | 7/2001 | Wu | |
| 6,283,612 | B1 | * | 9/2001 | Hunter | 362/240 |
| 6,322,226 | B1 | * | 11/2001 | Dickson | 362/33 |
| 6,350,041 | B1 | * | 2/2002 | Tarsa et al. | 362/231 |
| 6,406,161 | B1 | * | 6/2002 | Lin et al. | 362/250 |

OTHER PUBLICATIONS www.photonlamp.com, Photon Lamp, Ultra Efficient Solar Lighting System, Oct. 29, 2000.*

Andrew Bierman; *LEDS: from indicator to illumination* Lighting Futures, vol. 3 No. 4, 1998 Rensselaer Polytechnic.

Neil Savage: *LEDs Light the Future* ; Technology Review, Sep. 2000 www.technologyreview.com/magazine/sep00/savage.asp.

Photon Lamp, Ultra Efficient Solar Lighting System www-.photonlamp.com.

The Light Source: Ultrabright Light Emitting Diodes www.railwaylights.com/content/out_technology/light_source.html.

Kenneth Betz; Energy User News: *Little Things Mean a Lot* Aug. 10, 2001. www.energyusernews.com/CDA/ArticleInformation/features/BNP_Features_Item/0 . . .

* cited by examiner

*Primary Examiner*—Alan Cariaso
*Assistant Examiner*—Ismael Negron
(74) *Attorney, Agent, or Firm*—Randal D. Hamburg

(57) ABSTRACT

A low voltage LED interior lamp for residential and commercial lighting, includes a plurality of high lumen bright white LED lights incorporated within the lamps, a light color diffusion panel and a household current to low voltage DC converter providing power to the lamp to convert the AC current to low voltage DC current, reducing power required to provide illumination for the resident or commercial application without requiring replacement of the LED lights.

1 Claim, 2 Drawing Sheets

INTERIOR LAMP FOR PRODUCING WHITE LIGHT USING BRIGHT WHITE LEDS

CROSS REFERENCE TO RELATED APPLICATIONS

None

I. BACKGROUND OF THE INVENTION

1. Field of Invention

The invention is a low voltage LED interior lamp for residential and commercial confined area lighting, having a plurality of high lumen white LED lights incorporated within the lamps, a colorized diffusion panel and a household current to low voltage DC converter providing power to the lamp to convert the AC current to low voltage DC current, saving on the cost of power required to provide illumination for the resident or commercial application and virtually eliminating the need to replace incandescent or fluorescent bulbs, the LED lights having an average duration of over 150,000 hours.

2. Description of Prior Art

The following United States patents and publications were discovered and are incorporated and disclosed within this application for utility patent. All relate to LED lighting devices and technology.

In U.S. Pat. No. 6,149,283 to Conway, et al., an LED lamp with a reflector and a multi-color adjuster is disclosed, the bulb having an Edison bulb base, which allows for the choice of color by turning knobs located on the sides of the bulb. A multi-colored LED lighting array is disclosed in U.S. Pat. No. 6,016,038 to Mueller, et al., this device having an LED light array of red, blue and green LEDs controlled by a computer programming means.

A low-tension lighting device is provided with one or more LEDs having a control circuit to produce a low consumption, long-life lighting source, the device having a conventional screw-type mounting base for connection to a standard light socket. In U.S. Pat. No. 5,848,837, an LED is included in a integrally formed linear strip, which would mainly be used for marking paths or to define a low lumen decorative edge lighting, but marginally useful for actual area illumination.

A method and apparatus for retrofitting a traffic signal lamp with an LED lamp module is disclosed in U.S. Pat. No. 6,268,801 to Wu and. This patent discloses a high lumen variation of an LED as traffic control devices must be seen in daylight from a fairly good distance. Two more LED light bulbs are disclosed in U.S. Pat. Nos. 6,227,679 to Zhang, et al., and 5,655,830 to Ruskouski, these bulbs replacing conventional bulbs with arrays of LED lights. A luminaire is disclosed in U.S. Pat. No. 6,250,774 to Begemann, et al., which describes the use of LEDs for exterior illumination. It mentions specifically using LED arrays for street lights, floodlights and other types of outdoor lighting, describing specific types and styles of fixtures and their general design. This patent discloses that LEDs can be used for high-lumen lighting, referencing only the quantity of illuminating lumens without specifics as to quality of illumination, mainly concerning with spot lighting illumination.

A white light-emitting diode and method of manufacture is disclosed in U.S. Pat. No. 6,163,038 to Chen, et al. This type of white light LED is preferred as the LED utilized in the present invention, which incorporates a plurality of white light LEDs into each fixture variation of the present invention.

Several other publications refer to LED technology and lighting, although not addressing the specific nature of the present invention. In an educational article found at http://www.lrc.rpi.edu/futures/LF-LEDs/index.html by the Rensselaer Polytechnic Institute in Lighting Futures "LEDs: From Indicators to Illumination?", Volume 3 Number 4, 1998, a discussion is held regarding the future use of LED's for general purpose lighting, if only the bright white LEDs would ever become available.

In Technology Review, September/October 2000, an article entitled "LEDs Light the Future", by Neil Savage, future use of LEDs for general lighting is also discussed. However, at that time, high lumen output LEDs produced a very bland white light. Unlike normal white light, which is a combination of all the light of the visible spectrum, white LEDs produce only a very narrow band of visible light output, resulting in a very dull and grey white light. Color perception under this lighting is quite poor.

A bright light LED desk lamp is displayed in an advertisement for a photon lamp, the web site located at http://www.photonlamp.com/. This lamp uses bright white LED lighting using a Nickel Metal Hydride battery pack with a solar module recharger allowing the lamp to be used for up to 3 hours per charge, with a 100,000 hours of usage on the light bulbs, with an optional 115 VAC wall cube operation and recharger for the batter pack.

Ultrabright Light Emitting Diodes are used for railroad lighting replacements of incandescent bulbs in an article for RailwayLights.com, wherein LED light arrays are used to replace conventional railway lights supplied in blue, yellow, red and green light replacements, focusing on the lowered radiation output, the longer life and the lowered electrical usage of these replacement lights.

II. SUMMARY OF THE INVENTION

The primary objective of the invention is to provide an indoor lighting device utilizing a plurality of bright white LEDs to produce a high lumen output tabletop lighting device utilizing a small portion of the electricity required to illuminate a conventional lamp fixture.

A secondary objective of the invention is to provide the indoor lighting device utilizing a plurality of bright white LEDs to produce a high lumen output area and spot light fixture which does not require replacement of any bulbs or lighting tubes during the reasonable life of the fixture.

A third objective of the invention is to provide the light device with an AC/DC power converter in the lamp having an input for an emergency power supply including an automobile battery or other DC battery backup source, allowing for several lamps and light fixtures to be daisy-chained for full residential and commercial illumination in the event of a power outage or shortage. Additionally, these devices can be run from less expensive power source, including solar cells, wind turbines and water wheels, these fixtures requiring low voltage DC power which is easily supplied by less costly means than AC power, including rechargeable battery cells.

LED lighting has several advantages over conventional lighting, including incandescent and fluorescent lighting. With incandescent bulbs, almost 85% of the energy used in the bulb is given off as heat, making such incandescent light bulbs very inefficient as a light source. Due to their design, these bulbs have a very short lifespan and require frequent replacement. A great deal of light fixture design is concerned with protection from heat or low wattage bulbs, due to the excessive heat produced by conventional incandescent bulbs. Dimmer switches used on incandescent fixtures have a high level of resistance and, as result, also can give off huge amounts of heat due to the resistance of the 115 volt household current. Fires and electrocutions are possible with conventional lighting fixtures and wiring and accidents and electrical shorts are common occurrences.

With fluorescent lamps, 110 or 220 volt current is still required and they are operated by very expensive ballasts, which die not withstand time or exposure to heat. They are long and cumbersome to replace, and if they explode due to slight contact, they can become quite dangerous, with sharp, flying glass fragments. Fluorescent bulbs generally cannot be dimmed, although some are equipped with a dimmer, tend to flicker, which is disturbing to a user. Some fluorescent bulbs are equipped with Edison light bulb attachments, but these are usually bigger than their incandescent replacement subjects and can disrupt the fixture to which they are applied.

With the present invention, the advantages associated with the incorporation of the bright white LEDs into the lamp lie in the energy efficiency of the lighting, producing the same amount of visible area lighting using a mere fraction of the energy as incandescent and fluorescent bulbs and without the heat associated with spot lighting of an area. Using the color spectrum diffusion element over the bright white LEDs produces a color enhanced light giving such LED light the same character as conventional lighting. LED bulbs have a much greater lifespan, thereby making the bulbs in the lamp virtually free from replacement, allowing the direct incorporation of the LEDs into the lamp, providing a much more flexible use without concern over excessive heat, bulky bulbs or replacement access, such LEDs providing in excess of 100,000 hours of light. Additionally, emergency lighting can be gained using the lamp and a DC battery, including hooking the lamp into a car cigarette lighter for emergency household lighting during a power outage or shortage or for use in an automobile. Adaptation to existing solar power is also an available option for this low consumption lighting lamp.

As to the style of the LED Interior Lamp, these are suited for tabletop use, floor use and desktop use. Due to the low voltage wiring, any configuration is possible, because the weight of the wiring, the accessibility to the bulbs and the expanded choice of materials available due to the low heat output of the illumination source. Completely cordless (internal low voltage power source) embodiments and variations are also possible, allowing for the lamps to be utilized as independent works of art including an illumination source.

III. DESCRIPTION OF THE DRAWINGS

The following drawings are submitted with this utility patent application.

IV. DESCRIPTION OF THE PREFERRED EMBODIMENT

The invention is a low voltage bright white LED interior lamp utilizing DC power, for area or spotlighting, the device comprising essentially a base unit 20*a*, 20*b*, an AC/DC power converter 30*a*, 30*b*, a bright white LED light source 40*a*, 40*b*, a colorized diffusion panel 70*a*, 70*b*, and a power switch 80*a*, 80*b*. (For purposes of this device, a bright white LED light source is defined to include those LEDs, regardless of size, lumen output or shape, which produces a spectrum of light wavelengths which appear white, near white or close to a natural light, to a human observer.)

Figure 1:
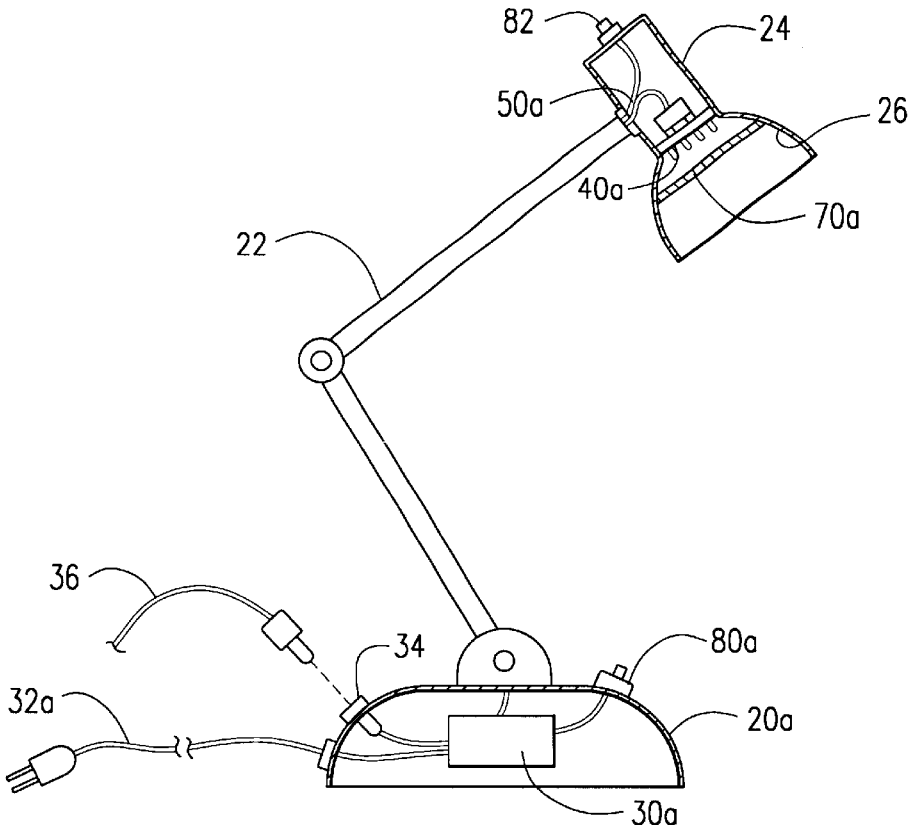
FIG. 1 is a drawing of a lamp with a detachable household electrical attachment, a DC transformer in the base, and a dimmer power switch on the base, with an LED in the lamp with a reflective lamp insert.
Figure 3:
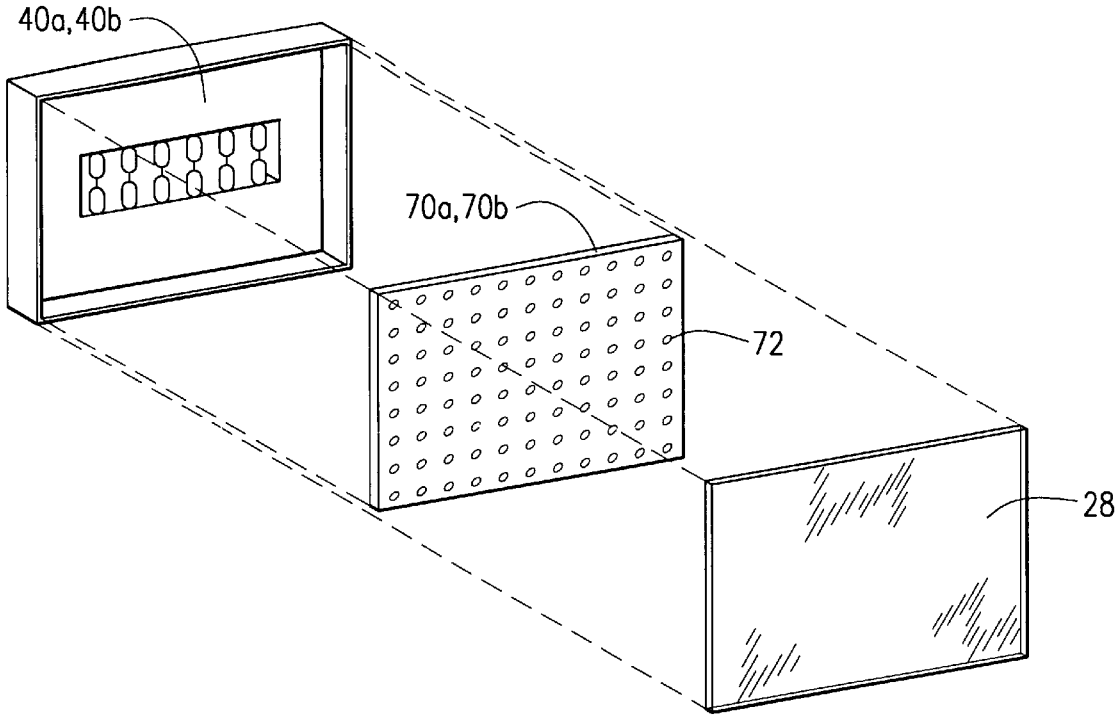
FIG. 3 is a drawing of the invention with the colored light diffuser plate.
Figure 4:
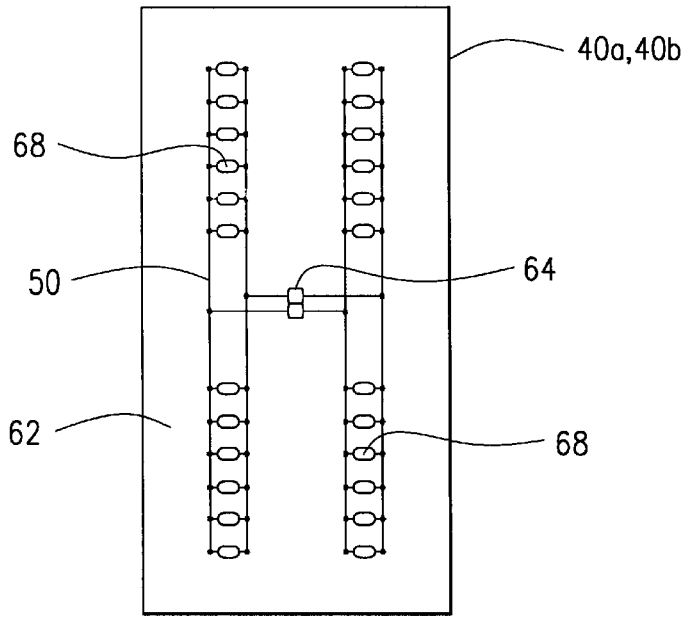
FIG. 4 is a drawing of the typical wiring of an LED array.

In a first embodiment, as shown in FIG. 1 of the drawings, the device is a desk lamp, having the base unit 20*a* within which is located the AC/DC power converter 30*a*. The AC/DC power converter 30*a* has attached the power switch 80*a* which is included in the base unit 20*a*. An AC power cord 32*a* is supplied, connecting the AC/DC power converter 30*a* within the base unit 20*a* to an AC power source. A retractable arm 22 is included upon the base unit 20*a*, having low voltage electrical wiring 50*a* connecting the AC/DC power converter 30*a* to the bright white LED light source 40*a*, the bright white LED light source 40*a* having a plurality of bright white LED lamps 68, which may be configured as shown in FIG. 4 of the drawings. Most preferably, this embodiment would include a lamp head 24 having a reflective inner lining 26. The colorized diffusion panel 70*a* is positioned in front of the bright white LED light source 40*a*. A dimmer switch 82 may also be included in the base unit, allowing the user to variably control the amount of light desired. In an alternative embodiment, not shown, the AC/DC power converter 30*a* may be included on the AC power cord 32*a*, and therefore omitted from inclusion within the base unit 20*a*. A closer view of an example of a bright white LED light source 40*a*, 40*b* is shown in FIG. 4, which illustrates a cluster panel backing material 62, DC contact points 64, and low voltage electrical wiring 50 connecting the plurality of bright white LED lamps 68 in a parallel array. In FIG. 3, a further illustration of the colorized diffusion panel 70*a*, 70*b* is shown. At this time, in the known art, bright white LED lamps 68 provide illuminating light, but often the light is observed as a grey light due to the bright white LED lamps 68 only emitting light in a portion of the visible spectrum as opposed to the full visible spectrum. Some colors under this bright white LED light appear to be washed or grey. The colorized diffusion panel 70*a*, 70*b*, placed in front of the bright white LED light source 40*a*, 40*b*, provides enhanced visible spectrum illumination, wherein the colorized diffusion panel 70*a*, 70*b* includes a dense colored dot matrix 72 of green, blue, yellow and red transparent colored dots. As the emitted bright white LED light is passed through the dense colored dot matrix 72, the light takes on the wavelength of the colored dots. The human eye, observing a full color spectrum of light, perceives the combination of colored light as "white", making the illuminated area appear more vibrant. At some point, when bright white LED lights are developed to broadcast light in a full color spectrum, this colorized diffusion panel 70*a*, 70*b* may be eliminated. In addition, the colorized diffusion panel 70*a*, 70*b* also disperses the light and spreads it about the illuminated area. In this sense, the colorized diffusion panel may be multi-faceted or provided in a wide array of gemstone of geometrically varied shapes and thicknesses. Another embodiment would provide the colorized diffusion panel 70*a*, 70*b* placed between the bright white LED light source 40*a*, 40*b* and a transparent diffusion panel 28, more clearly illustrated in FIG. 3 of the drawings.

Figure 2:
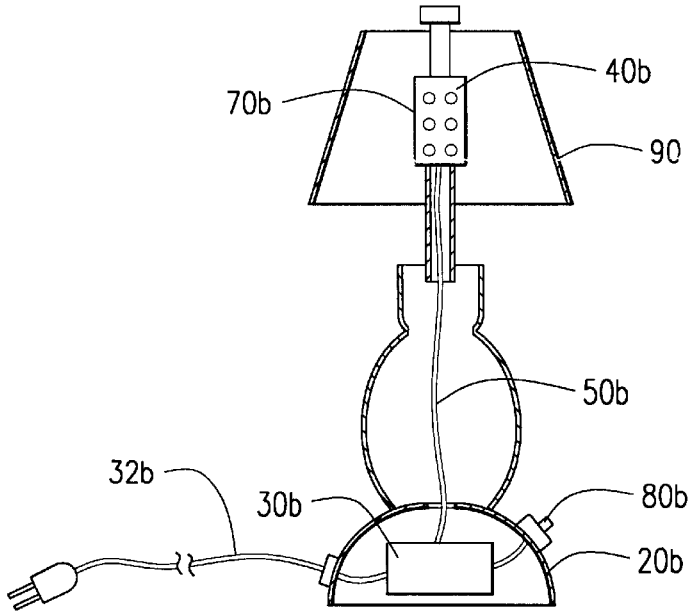
FIG. 2 is a drawing of a table lamp with a DC transformer incorporated into the base.

This invention may also be provided in the form of a decorative table lamp, as shown in FIG. 2 of the drawings, including a lamp shade 90 around the bright white LED light source 40*b* included within the colorized diffusion panel

70*b*. This embodiment also includes the base unit 20*b*, the AC/DC power converter 30*b*, the AC power cord 32*b*, the low voltage electrical wiring 50*b* and the power switch 80*b*. The selection of material for a lamp shade 90 in this device is much more broad than lamp shades used with standard incandescent bulb lamps, due to the substantial reduction in heat output of bright white LED light sources versus incandescent light bulbs. This allows for the use of more delicate fabrics, including paper, silk or other materials that would pose a fire hazard or would be discolored from the heat given off by an incandescent light source.

In both embodiments, an alternate DC power supply input 34 may be provided to allow for the connection of the device to a DC power source 36, including a battery backup or battery supply, in the event of a power outage, allowing the device to be used when no other power source is available. In another embodiment, not shown, the device may include a built in rechargeable battery power supply.

While the invention has been particularly shown and described with reference to a preferred embodiment thereof, it will be understood by those skilled in the art that changes in form and detail may be made therein without departing from the spirit and scope of the invention.

What is claimed is:

1. An LED interior lighting device essentially comprising:

a base unit including an AC/DC power converter and a power switch;

an AC power cord attaching to the base unit, a bright white LED light source having a plurality of bright white LED lamps, said bright white LED light source included within a lamp head having a reflective inner lining;

a colorized diffusion panel having a dense colored dot matrix of green, blue yellow and red transport color dots, positioned in front of the bright white LED light source; and a retractable arm extending from the base unit, having a low voltage electrical wiring connecting the AC/DC power converter to the bright white LED light source.

* * * * *